US005904373A

United States Patent [19]

Krapf

[11] Patent Number: 5,904,373

[45] Date of Patent: May 18, 1999

[54] FLEXIBLE DOCUMENT SUPPORTING JACKET WITH MAGNETIZED MOUNTING STRIPS

[76] Inventor: Wallace A. Krapf, 1933 O'Neill Rd., Macedon, N.Y. 14502

[21] Appl. No.: 08/898,390

[22] Filed: Jul. 22, 1997

[51] Int. Cl.[6] ..... B42D 17/00; B42F 5/04; B42F 11/00

[52] U.S. Cl. ..... 281/29; 281/31; 281/38; 402/79; 40/771; 40/772; 40/776

[58] Field of Search ..... 281/31, 38; 402/79; 40/771, 772, 776

*Primary Examiner*—Willmon Fridie, Jr.
*Assistant Examiner*—Mark T. Henderson
*Attorney, Agent, or Firm*—Shlesinger, Fitzsimmons & Shlesinger

[57] ABSTRACT

The jacket has flexible front and rear walls which are connected together along the bottom and one side of the jacket, but which are separable from each other along the top and other side of the jacket to enable a document to be inserted between, or to be removed from between the front and rear walls. The rear wall has secured to the back thereof two, flexible magnetic strips for removably securing the upper and lower ends of the back wall against the face of a ferrous metal panel. The front wall, which is transparent extends slightly beyond the back wall adjacent the top and other side of the jacket and has secured to the back thereof along its upper edge another flexible magnetic strip which releasably engages the face of the supporting panel to hold the jacket closed when mounted on the panel.

12 Claims, 3 Drawing Sheets

FLEXIBLE DOCUMENT SUPPORTING JACKET WITH MAGNETIZED MOUNTING STRIPS

BACKGROUND OF THE INVENTION

This invention relates to a flexible document supporting jacket, and more particularly to such a jacket which is transparent, and has thereon magnetized strips for releasably mounting the jacket on a face of a metal display board or the like. More particularly this invention relates to a document supporting jacket of the type described in which a portion of one side of the jacket is removably secured to a registering portion of the other side of the jacket by means of a magnetized strip.

It has long been desirable in business and industrial settings to be able to display rather large, rectangular documents for examination by interested parties in various locations, for example in offices, and even on factory floors, where Cad Cam drawings and the like frequently are produced and modified during the development of a product. In the case of office displays, bar charts, line charts and the like also must be displayed and frequently also are subjected to various changes. For that reason, therefore, there is a need not only to provide means for readily and easily displaying such items, but also such display means must be designed so that the displayed items not only can be readily observed and protected from damage, but also must be such that the displayed item can be quickly removed for updating or replacement.

Heretofore it has been customary for certain items to be releasably mounted on the face of a ferrous metal object, as suggested for example in U.S. Pat. No. 4,258,493. In one embodiment this patent teaches the use of a magnetic strip, which is secured to the upper end of a document-holding envelope to hold the envelope on the face of a ferrous metal surface. U.S. Pat. No. 4,588,209 discloses a document-holding folio or notebook the front and back covers of which have secured thereon two elongate magnetic strips for releasably securing a stack of documents or papers in the notebook. When the front and back covers are closed the two magnetic strips overlie opposite sides of the stack of documents adjacent one edge there so that the stack is secured releasably between the magnetic strips.

Also, U.S. Pat. No. 4,255,837 suggests the use of supporting a clear, plastic pouch or bag on the face of a ferrous surface by means of two magnetic strips of foil which are folded over the upper end of the bag so that the confronting faces of the foils are magnetically clamped to each other over the upper end of the bag, while one of the foils in turn is employed to secure the assembly magnetically to the face of a ferrous board, or the like. In U.S. Pat. No. 5,274,293 a document holder includes two overlapping portions connected together along two intersecting edges and being separable from each other along the other two intersecting edges so that one portion of the holder can be separated from the other to enable the insertion into the holder of a flexible, magnetized sheet of material, which can be fixed in the holder or can be removable relative to the holder. However the magnetized sheet is designed to completely fill the interior of the holder and is not designed releasably to hold the folder in a closed position.

It is an object of this invention, therefore, to provide an improved document supporting jacket of the type described which has a transparent face for readily displaying any document mounted therein, and which jacket is disposed to be mounted removably on the face of a metal display board, or the like, by means of magnetized strips carried by the back of the jacket, and with a third magnetic strip employed holding the jacket closed.

Still another object of this invention is to provide an improved document supporting jacket of the type described in which two, rectangularly shaped layers of transparent material are seamed together along the registering, lower edges thereof, and along registering edges forming one side of the resulting jacket, but are releasably secured together along their remaining edges so that a portion of the front layer of the jacket can be releasably secured by a magnetic strip over a registering portion of the back layer of the jacket when the jacket is mounted by two other magnetic strips on the face of a ferrous metal display board, or the like.

Other objects of the invention will be apparent hereinafter from the specification and from the recital of the appended claims, particularly when read in conjunction with the accompanying drawings.

SUMMARY OF THE INVENTION

The novel jacket herein comprises a pair of rectangular, flexible, transparent sheets or panels of plastic material or the like, the lower edges of which are heat sealed or otherwise secured together permanently to close the bottom of the jacket. Also, a pair of registering side edges of the two layers or panels also are heat sealed or otherwise secured together permanently to seal closed one side of the jacket. The other side and top edges of the two panels remain free and are not secured together. Secured to the outer face of the rear layer or panel adjacent its upper and lower edges, respectively, are two spaced, parallel, flexible magnetic strips which are utilized for releasably mounting the jacket on the ferrous metal face of a conventional display board or the like.

The front layer or panel is slightly longer and wider than the rear panel, so that a portion of the free side edge thereof extends slightly beyond the corresponding free side edge of the rear panel. Also, the upper edge of the front panel extends slightly above the upper edge of the rear panel, and has secured thereon adjacent and parallel to its upper edge another strip of flexible magnetic material which is utilized normally to engage the face of the board upon which the jacket is mounted, thereby releasalby to secure the front panel closed over the rear panel. If it is desired to insert a document into or withdraw it from the interior of the jacket, the upper right-hand corner of the front panel, in the embodiment illustrated, is grasped and pulled away from the display board, and relative to the rear panel, thus folding a generally rectangularly shaped portion of the front panel away from a registering portion of the back panel, thereby opening the jacket for insertion or withdrawal of a document. Thereafter the open portion of the front panel is returned to its closed position in which the magnetic strip thereon releasably engages the face of the display board in an area spaced slightly above the upper edge of the rear panel.

THE DRAWINGS

DETAILED DESCRIPTION OF THE PREFERRED EMBODIMENTS

Figure 1:
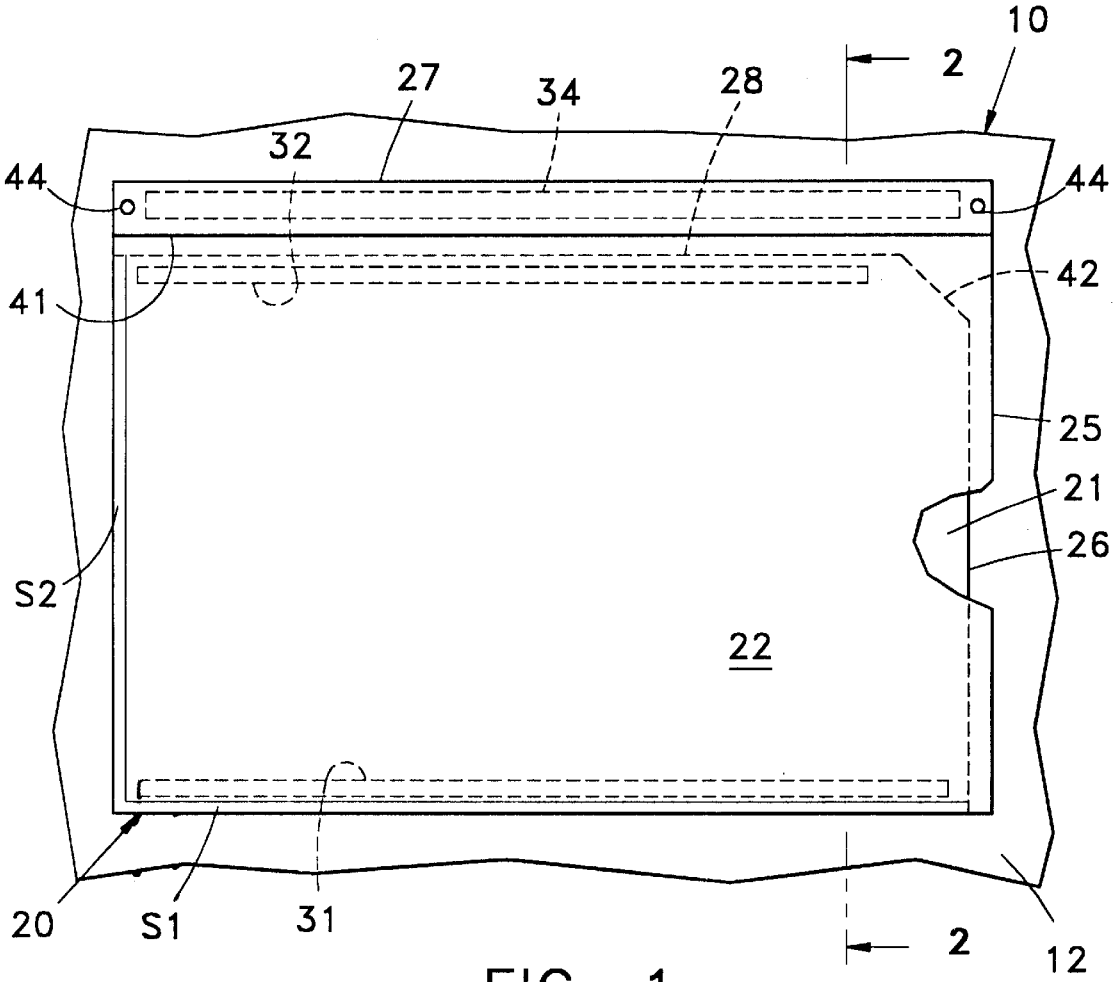
FIG. 1 is a front elevational view of a flexible document supporting jacket made according to one embodiment of this invention, the jacket being shown as it appears when mounted in a closed position on the face of a metal display board, which is shown fragmentarily in FIG. 1.

Referring now to the drawings by numerals of reference, 10 denotes generally part of a conventional display board of the type having secured to its face or immediately beneath its face, a metal (ferrous) layer 12, which may have thereon a conventional coating permitting information to be written thereon, for example, by a write-on, wipe-off type of pen. Typically, such boards also are designed to have magnetic items releasably mounted on the face thereof. One such item, which in the drawings is denoted generally by the numeral 20, constitutes a novel supporting jacket made according to this invention.

Figure 3:
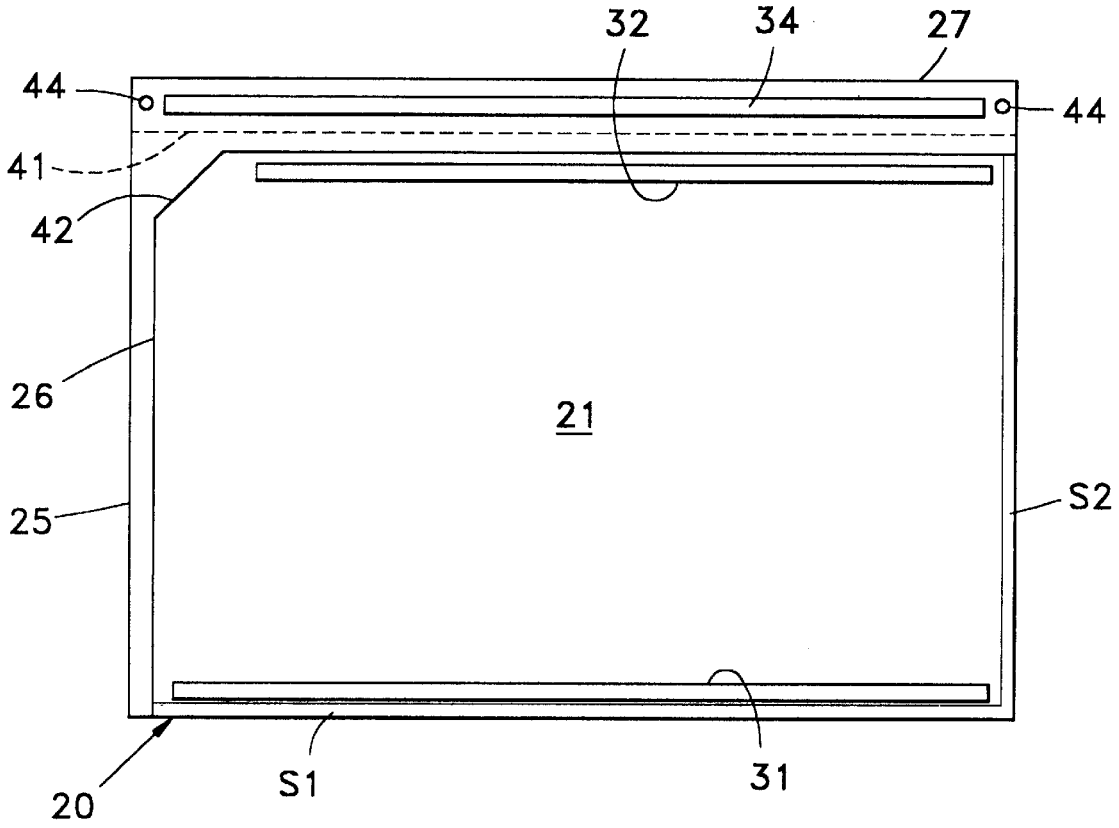
FIG. 3 is a rear elevational view of this novel jacket as seen for example when a section is taken along the line 3—3 in FIG. 2 looking in the direction of the arrows.

Jacket 20 comprises two rectangularly shaped, flexible, transparent layers or panels 21 and 22 of plastic material having registering, lower edges 23 and 24, respectively. Marginal portions of the lower edges 23 and 24 are heat sealed or otherwise secured together to form a closed seam S1, which extends along and closes the lower end of jacket 20. As shown more clearly in FIGS. 1 and 3, the front panel 22 is slightly longer and wider than the rear panel or layer 21, so that a marginal portion of one side edge 25 of panel 22 (the right hand side edge thereof as shown in FIG. 1) extends slightly beyond the adjacent side edge 26 at the rear panel 21. The other side edge of the rear panel 21 has a marginal portion thereof heat sealed or otherwise secured to a registering marginal portion of the other side edge of the front panel 22, thereby forming along one side of the jacket 20 (the left side as shown in FIG. 1) a seam S2, which closes the left side of the jacket as shown in FIG. 1. The wider panel 22 also has a portion thereof adjacent its upper edge 27 that extends beyond the upper edge of the narrower back panel 21.

Notably, the upper edge 28 of the rear panel 21, and the side edge 26 of the rear panel are not secured in any way to registering portions of the front panel 22, so that a generally triangularly shaped portion of the front panel bound by its intersecting edges 25 and 27 can be moved or folded away from the registering portion of the rear panel 21, as noted hereinafter.

Figure 2:
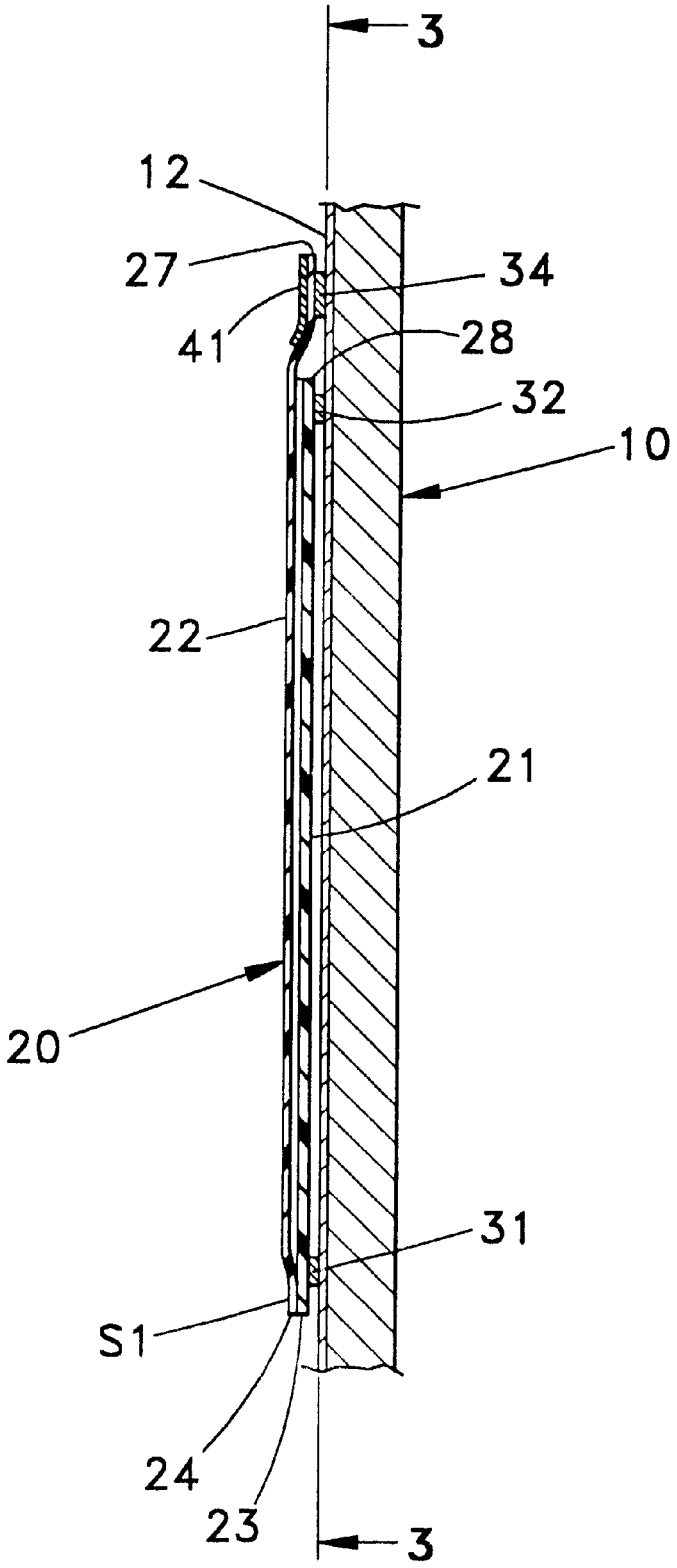
FIG. 2 is a sectional view taken generally along the line 2—2 in FIG. 1 looking in the direction of the arrows.

For removably mounting the jacket 20 on the face of board 10, two elongate, flexible magnetic strips 31 and 32 are secured to the rear face of panel 21 to extend longitudinally of the panel in spaced, parallel relation to each other, and adjacent and parallel to the lower and upper edges 23 and 28, respectively, of panel 21. To maintain the front panel 22 releasably closed over the back panel 21, when the jacket 20 is mounted on the board 10 as shown for example in FIG. 2, an elongate, flexible strip 34 of magnetic material is secured to and extends longitudinally of the front panel 22 immediately adjacent to and parallel to the upper edge 27 thereof. As shown more clearly in FIG. 2, when the jacket 20 is mounted on the board 10, the magnetic strip 34 is releasably held by magnetic attraction against the face of board 10, and along a line axially spaced above and parallel to the upper edge 28 of the back panel 21. If it is desired to open the jacket to insert a document into or withdraw it from the jacket, one need only to grasp the upper right-hand corner of the front panel 22, as shown in FIG. 1, and then withdraw the magnetic strip 34 away from the face of panel 10. This will cause the above-noted triangularly shaped portion of the front panel 22 to be drawn away from the rear panel 21 so that the jacket will be opened for inserting or withdrawing a document. Once the document has been inserted in the jacket one need only to return the upper right hand corner of the front panel 22 to its closed position as shown in FIGS. 1 and 2, at which time the magnetic strip 34 once again will be held releasably against the face of board 10, thus enclosing within a jacket any document which may have been inserted therein while the front panel 22 was in its open position.

The advantage of this construction is that, not only is jacket 20 rather inexpensive to prepare, but it also requires no special clips or brackets for mounting it on a board 10, or for retaining the front panel 22 in its closed position. The magnetic strips 31, 32 and 34 are permanently secured to the associated portions of the panels 21 and 22, so they never become separated from the jacket. Also, the front panel 22 or face of the jacket is transparent so that any document enclosed therein will be readily observable by anyone examining the board 10. Moreover, to enable identifying information or data to be mounted on the face of the jacket 20, an elongate, opaque strip 41 of a flexible write-on/wipe-off material, or the like, is secured to the face of the outer panel 22 immediately adjacent and parallel to its upper edge 27. This strip not only covers and hides the closure strip 34 of magnetic material, when the jacket is closed, but also provides a convenient surface for marking or otherwise printing data on the face of the jacket. Also, to provide adequate room for one's fingers to be inserted behind the upper right-hand corner of the front panel 22, when it is to be folded to its open position, the upper, left-hand corner of the back panel 21 can be removed or cut away as at 42, if desired.

From the foregoing, it will be apparent that the present invention provides relatively simple and inexpensive means for displaying documents on display boards located in any one of a variety of different places, such as in offices, and even on factory floors, where it is often desired to display machine shop drawings or the like. Jacket 20 not only provides a ready means for displaying such documents, but also protects the documents against damage while being displayed. Also, to remove or insert a document in the jacket it is not necessary to remove the jacket from the board 10, but merely to peel back the upper right-hand corner of the jacket. If desired, in addition to utilizing the strip 41 for recording thereon data, even the face of panel 21 could be written upon and wiped away by a write-on/wipe-off ink panel or the like, if necessary. Also if for some reason it is desired to hang the jacket, circular holes 44 or the like can be employed in the upper corners of the front panel 22.

While this invention has been illustrated and described in detail in connection with only certain embodiments thereof, it will be apparent that it is capable of still further modification, and that this application is intended to cover any such modifications as may fall within the scope of one skilled in the art or the appended claims.

I claim:

1. A flexible document supporting jacket, comprising a flexible transparent front panel, and a flexible rear panel, each panel having spaced upper and lower edges, respectively, and spaced side edges extending transversely of said upper and lower edges, said rear panel being connected along said lower edge thereof to said lower edge of said front panel, and along one of said spaced side edges thereof to one of said side edges of said front panel, thereby forming a closed lower end and a closed side of a jacket, and an open upper end and an open side of said jacket, at least one flexible magnetic strip secured to said rear panel adjacent the upper edge thereof, and operable to secure said rear panel magnetically and releasably to a ferrous metal support, said front panel being larger than said rear panel, whereby marginal portions of said front panel adjacent said upper edge and the other side edge of thereof extend beyond, respectively, said upper edge and other side edge of said rear panel, and a flexible magnetic strip secured to one side of said marginal portion of said front panel adjacent said upper edge thereof and operable releasably to secure said marginal portion of said upper edge of said front panel to said ferrous metal support above the upper edge of said rear panel, when said rear panel is secured thereto, thereby releasably to close said upper end of said jacket.

2. A flexible document supporting jacket as defined in claim 1, including another flexible magnetic strip secured to said rear panel adjacent said lower edge thereof and operable to secure the lower end of said jacket against said ferrous metal support when said rear panel is secured thereto.

3. A flexible document supporting jacket as defined in claim 1, wherein said one and said other flexible magnetic strips are secured to said rear panel for direct engagement with said ferrous metal support.

4. A flexible document supporting jacket as defined in claim 1, wherein said flexible magnetic strip which is secured to said front panel is directly engagable with said ferrous metal support to close said upper end of the jacket.

5. A flexible document supporting jacket as defined in claim 4, wherein an opaque, flexible strip of write-on/wipe-off material is secured to the opposite side of said marginal portion of said front panel and in registry with the magnetic strip that is secured to said front panel.

6. A flexible document supporting jacket as defined in claim 1, wherein said rear panel is transparent.

7. A flexible document supporting jacket as defined in claim 1, wherein said marginal portion of said front panel adjacent said upper edge thereof has therethrough two spaced openings located adjacent opposite ends thereof, respectively.

8. A magnetic document supporting device, comprising a generally rectangularly shaped jacket having registering flexible front and rear wall sections of generally planar configuration, said wall sections having first portions thereof connected together along intersecting seams extending along and forming, respectively, the bottom and one side of said jacket, and having separable portions thereof disconnected from each other and forming the other side and the top of said jacket thereby to permit said separable portions to be separated from each other to allow the insertion of a document into said jacket between said wall sections, magnetic means on said rear wall section of said jacket for removably securing said rear wall section and said separable portion thereof on a ferrous metal panel removably to support said jacket thereon, and magnetic means on said front wall section operable, when said rear wall section is secured on said panel, releasably to retain the separable portion of said front wall section over the separable portion of said back wall section, thereby releasably to close said jacket over any document mounted therein.

9. A magnetic document supporting device as defined in claim 8, wherein said front wall section is larger than said rear wall section and has marginal portions thereof adjacent the top and said other side of said jacket which extend beyond said rear wall section adjacent the top and said other side of said jacket.

10. A magnetic document supporting device as defined in claim 9, wherein said magnetic means on said front wall section comprises a flexible magnetic strip secured to and extending longitudinally of said marginal portion of said front wall section adjacent said top of said jacket.

11. A magnetic document supporting device as defined in claim 10, wherein said magnetic means on said rear wall comprises a pair of spaced, flexible magnetic strips secured to said rear wall section to extend longitudinally between opposite sides of said jacket adjacent the top and bottom, respectively, of said jacket.

12. A magnetic document supporting device as defined in claim 11, wherein said front wall section is made from a transparent plastic material.

* * * * *